United States Patent [19]

Cohen et al.

[11] Patent Number: 5,038,803

[45] **Date of Patent: * Aug. 13, 1991**

[54] METHOD AND DEVICE FOR CONTROL OF BY-PRODUCTS FROM CIGARETTE SMOKE

[75] Inventors: Richmond R. Cohen, Hockessin, Del.; David J. Gibboni, Drexel Hill, Pa.

[73] Assignee: Hercules Incorporated, Wilmington, Del.

[ * ] Notice: The portion of the term of this patent subsequent to Mar. 14, 2006 has been disclaimed.

[21] Appl. No.: 214,249

[22] Filed: Jul. 1, 1988

Related U.S. Application Data

[63] Continuation-in-part of Ser. No. 152,213, Feb. 4, 1988.

[51] Int. Cl.[5] ..... A24D 3/06; A24D 3/14; A24D 3/16

[52] U.S. Cl. ..... 131/342; 131/341; 131/345

[58] Field of Search ..... 131/331, 334, 341, 342, 131/343, 345

[56] References Cited

U.S. PATENT DOCUMENTS 2,429,567 10/1947 Sowa .
3,403,690 10/1968 Horsewell .
3,428,056 2/1969 Sublett et al. .
3,434,479 3/1969 Till et al. .
3,476,120 11/1969 Kiefer et al. .
3,605,759 9/1971 Owens et al. .
3,635,226 1/1972 Horsewall et al. .
4,246,910 1/1981 Radner et al. .

FOREIGN PATENT DOCUMENTS 3200068 1/1982 Fed. Rep. of Germany .
1103823 2/1968 United Kingdom .

*Primary Examiner*—V. Millin
*Attorney, Agent, or Firm*—John E. Crowe

[57] ABSTRACT

Method for controlling delivery of by-products found in cigarette smoke by utilizing a cigarette filter element comprising one or more substrates treated with an effective amount of at least one of (A) zinc chloride, ferrous bromide, calcium bromide, lithium bromide, zinc thiocyanate, sarcosine hydrochloride, manganese sulfate, manganese acetate, magnesium chloride and magnesium acetate; alone or combined with (B) glyceryl triacetate; plus corresponding treated filter element(s) and cigarette(s) utilizing such filter elements(s).

33 Claims, 2 Drawing Sheets

METHOD AND DEVICE FOR CONTROL OF BY-PRODUCTS FROM CIGARETTE SMOKE

Figure 1:
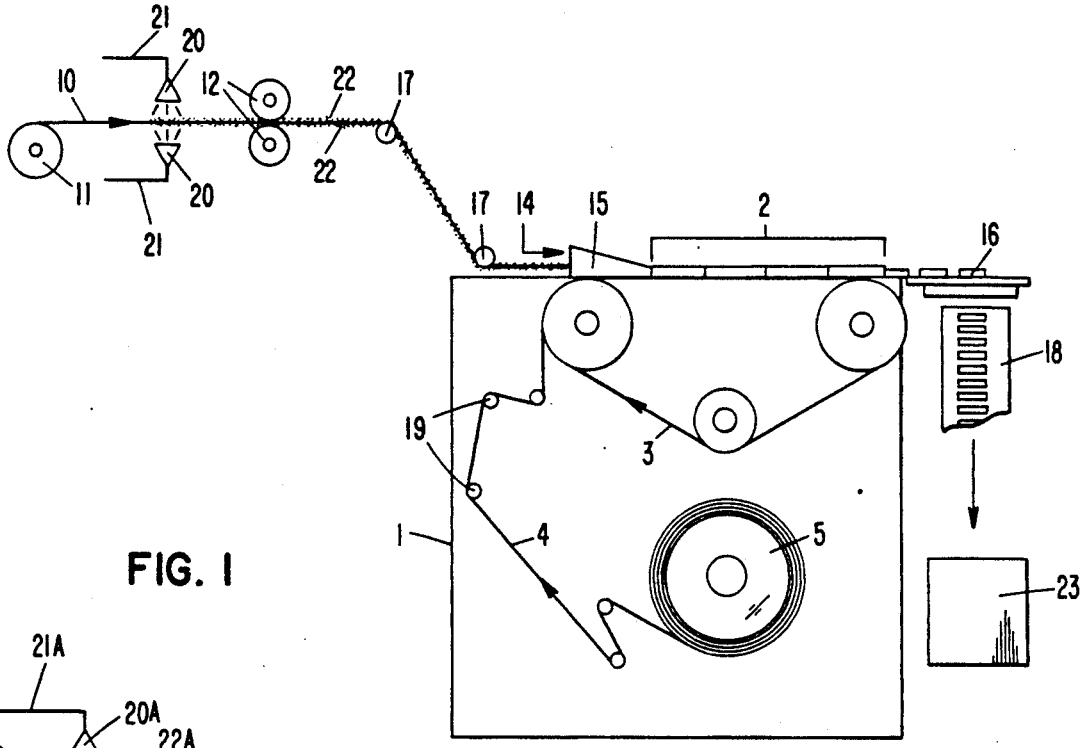

The present invention is a continuation-in-part of copending U.S. Ser. No. 152,213 filed Feb. 4, 1988 entitled METHOD AND DEVICE FOR CONTROL OF BY-PRODUCTS FROM CIGARETTE SMOKE, which relates to an improved method for selectively controlling delivered concentrations of particulate matter and certain other undesired by-products in cigarette smoke by using a cigarette filter element treated with at least one active modifier component.

BACKGROUND

Although fiber-based cigarette filter elements are well known and have been used for a number of years, the choice of components for this class of filters has remained quite limited over the years, due to cost factors and lack of general suitability of many natural fibers for high speed filter production using state of the art filter rod-making apparatus. In addition, the demands on present day commercial cigarette filter elements tend to conflict with respect to characteristics such as general filtration efficiency, selective filtration, draw, and filter element hardness.

While various synthetic fibers and fiber mixtures have been tried and evaluated, a substantial number of cigarette filter elements continue to favor old technology using cellulose acetate-based fiber, because of certain cost and handling advantages. For example, cellulose acetate tow can be processed into cuttable filter rods using an essentially unmodified state-of-the-art filter rod-making apparatus without serious jamming problems. This advantage is enjoyed despite present day need for substantial amounts of additives, including non-volatile liquid organic plasticizers such as triacetin, diacetin, citric acid, as well as lubricants, flavors, medicines, and selective filtering agents and the like. Generally, such additives are applied as aqueous solutions onto opened cellulose acetate fiber tow by dipping, spraying, and printing. In the case of plasticizer additives, the resulting softened areas are capable of randomly adhering to adjacent crimped fiber to impart some degree of rigidity or hardness to the resulting plug and filter rod, permitting subsequent cutting into filter element length.

The above-stated advantages of cellulose acetate fiber, however, are countered by certain serious disadvantages. For example, such fibers tend to be relatively weak (1.0–1.2 g./denier) compared with synthetics such as polyolefin fiber. This characteristic seriously limits the amount of tension and crimp that acellulose acetate fiber tow of low dpf fiber or filament will tolerate prior to introduction into a conventional filter rod-making apparatus.

Synthetic fiber components, particularly polyolefins such as polypropylene staple, offer a valuable alternative since they are easily drawn to a small denier and offer potentially high filter efficiency without significant loss of the strength needed for crimping and the tension of high speed production.

Polyolefin fibers, however, also have some disadvantages. These generally arise from the fact that polyolefin-containing substrates are generally hydrophobic and tend to be chemically inert, while a majority of known potential additives tend to be somewhat hydrophilic and difficult to retain in proper amount and in functional condition within filter elements composed of hydrophobic synthetic fiber.

Another substantial problem, unique to the cigarette filter art, concerns the difficulty in optimizing fiber denier and general filter efficiency of synthetic fiber filters without corresponding sacrifice in dimensional stability, hardness, and draw (resistance to draw) across the filter element. In particular, polyolefin-containing substrates (e.g. open tows and slivers) fed into a filter rod-making apparatus, demonstrate significant negative correlation between draw and hardness of the filter element. In addition, it is sometimes difficult to avoid jamming of heavily impregnated synthetic substrates fed at high speed into a conventional filter rod-making apparatus, particularly where the additives include substantial amounts of the above-noted modifier components and the like dispersed in viscous carriers or vehicles. The jamming problem is believed due, at least in part, to deficiencies in lubricating properties of such additives.

It is an object of the present invention to economically produce cigarette filters having superior efficiency.

It is a further object of the present invention to more effectively and selectively control the delivery of by-products found in cigarette smoke, particularly tar, nicotine, formaldehyde and total particulate matter.

THE INVENTION

The above objects are obtained in accordance with the present invention comprising passing cigarette smoke through a tobacco smoke filter element of compacted substrate inclusive of at least one of (a) opened fiber tow, (b) ribbon of nonwoven material, (c) sliver, or (d) fibrillated film; and containing an effective amount of at least one active modifier component of at least one of zinc thiocyanate, sarcosine hydrochloride, zinc chloride, ferrous bromide, calcium bromide, lithium bromide, manganese sulfate, manganese acetate, magnesium chloride, magnesium sulfate, and magnesium acetate for controlling delivery of by-products found in cigarette smoke.

Of particular interest are such filter element(s) keyed to a method for controlling the delivery of tar, nicotine, formaldehyde, and total particulate matter found in cigarette smoke by passing the smoke through a polyolefin-containing filter element containing an effective amount of active modifier components comprising (A) at least one member selected from zinc chloride, zinc thiocyanate, sarcosine hydrochloride, ferrous bromide, calcium bromide, lithium bromide, manganese sulfate, manganese acetate, magnesium chloride, magnesium sulfate, and magnesium acetate; and (B) glyceryl triacetate.

If desired, one or more of the above active modifier components can be applied to separate substrate surfaces and introduced as garniture feed into a filter rod-making apparatus by dipping or spraying, or the component(s) subsequently drawn through the formed filter rod, using partial vacuum or the like, as hereafter noted, and dried.

An "effective amount of active modifier component", for purposes of the present invention, is an amount totaling about 0.05%–10% by weight or more, and preferably about 2%–5% of the above-defined (A) component; and up to about 5% by weight (0%–5%) and preferably 0.5%–5% of the (B) component, based on total weight of dry filter plug material.

Also within the scope of the present invention are filter elements containing surfactant material preferably about 0.1%-10% and preferably 0.5%-10% by weight of one or more of a class conveniently described as (1) a polyoxyalkylene derivative of a sorbitan fatty acid ester, (2) a fatty acid monoester of a polyhydroxy-alcohol, or (3) a fatty acid diester of a polyhydroxy alcohol.

Suitable surfactants for such purpose can include, for instance, ethoxylates, carboxylic acid esters, glycerol esters, polyoxyethylene esters, anhydrosorbitol esters, ethoxylated anhydrosorbitol esters, ethoxylated natural fats, oils and waxes, glycol esters of fatty acids, polyoxyethylene fatty acid amides, polyalkylene oxide block copolymers, and poly(oxyethylene-co-oxypropylene).

The term "substrate" here denotes a fiber- or film-containing component used as garniture feed for a filter rod-making apparatus, including one or more of opened fiber tow or the like, as above listed, such feed being conveniently introduced alone or in complete or partial register (see FIG. 2 and 3) for insertion into the garniture of a filter rod-making apparatus.

Such garniture feed can conveniently include up to about four or more webs of substrate component(s) of a homogeneous or mixed variety, the desired active components being applied onto one or both faces of selected substrates, the manner and number of faces treated depending upon the desired filter selectivity efficiency, taste, feel, hardness, and draw.

For purposes of the present invention, it is immaterial whether the garniture feed used is fabricated, in situ, (i.e. immediately upstream of the garniture) or earlier produced and stored before use.

It is also found suitable to use one or more nonwoven fabrics of the same or different fiber composition and denier as garniture feed, particularly when not all of the substrate in the filter element is to be used as a carrier surface for active modifier component(s).

When a ribbon of a nonwoven fabric is used as garniture feed component such can usefully comprise up to about 100% and preferably 10%-100% by weight of polyolefin (mono-, bi-, or tri-component) fiber identified generally as staple polypropylene, or may consist of webs having filaments of homogeneous or mixed denier, or combination of fibers such as (a) polypropylene/-polyethylene, polypropylene/polyvinylidene chloride, polypropylene/cellulose acetate, polypropylene/rayon, polypropylene/nylon, cellulose acetate/-polyethylene, plasticized cellulose acetate, polypropylene/paper; or (b) polypropylene/polystyrene/-polyethylene, and the like, in preferred ratios of about (a) 10%-90% 90%-10% or (b) 10%-90%/45%-5%/4-5%-5% based on fiber weight, and as generally described, for instance, in U.S. Pat. No. 3,393,685.

Fibrillated film can be employed as a substrate component for use alone or in combination with other substrate components as garniture feed within the present invention. Such can be obtained, for instance, in accordance with components disclosed in U.S. Pat. No. 4,310,594 (Yamazaki) and U.S. Pat. No. 3,576,931 (Chopra).

For present purposes, a conventional filter rod-making apparatus suitable for present purposes comprises a tow trumpet, garniture, shaping means, wrapping means, and cutting means in accordance with components and processes generally described, for instance, in U.S. Pat. No. 3,144,023 and U.S. Pat. No. 2,794,480. If desired, however, modifications can be made to permit in-situ or prior spraying, dipping, printing, vacuum draw, or other traditional application methods for introducing one or more modifier components of the present invention prior to or after the formation of a filter plug.

By way of further description, baled sliver or other substrate form can be continuously dip coated or feedably contacted by one or more printing roll(s) fed from reservoir(s) containing desired active components(s), followed by conventional drying steps using nip rolls, heated drying rolls, ovens, and the like, at temperatures usually within the range of about 70° C.-125° C.

Generally speaking, nonwoven material obtained from fiber having a wide denier range can be produced using art-recognized techniques. Preferably such material falls within a weight range of about 10-50 grams per $m^2$, and a ribbon width of about 4"-12" will generally assure successful passage through the garniture of a conventional filter rod-making apparatus at production speeds.

As above-indicated, the garniture feed may comprise up to about 4 or even more substrates of identical or different weight, dimensions, bonding properties, absorption properties, fiber composition, and fiber denier, which can be introduced wholly or partly in register into the garniture. For best results, however, one relatively lightly thermally bonded fabric, tow, sliver or fibrillated film in register with one nonwoven fabric, or between two nonwoven fabrics is found to offer a high degree of flexibility for adapting the resulting filter element to a variety of market needs, including cost, filter draw, and hardness parameters.

The inclusion of an additional low melting fiber such as polyethylene, combined with other polyolefin fiber as garniture feed is also found useful for obtaining tow plugs of widely varying bonding and liquid absorption or adsorption properties.

Cost-wise, opened fiber tow and nonwoven ribbons are found especially useful in this invention since they permit the use of relatively cheap polyolefin webs of mixed denier and type, and simplify the precise distribution of modifier components within a filter element without the need for abandoning usual art-recognized techniques and equipment such as printing rolls and spray heads for coating one or more nonwoven or other substrates, before forming a filter plug.

Supplemental components in addition to the above-defined active modifier components can also be employed such as, for instance, aqueous solutions, emulsions, suspensions or dispersions of one or more humectants generally exemplified by polyhydric alcohols such as glycerols, glycols, etc.; flavors and perfumes such as ketoses and polysaccharides, including wintergreen, spearmint, peppermint, chocolate, licorice, cinnamon, fruit flavors, citrus etc., and additives as otherwise found in U.S. Pat. No. 4,485,828 and 4,715,390; also including medicines, such as menthol and decongestants, etc.

Figure 3:
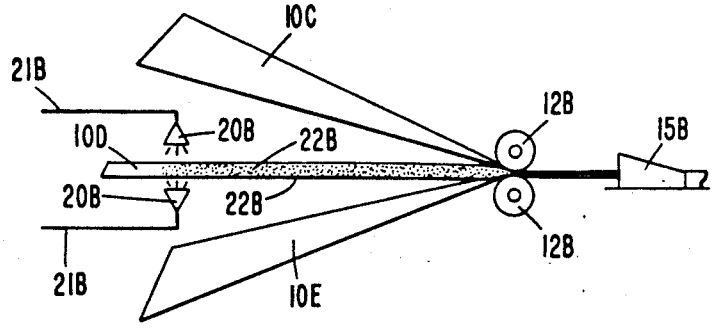

In order to maintain precise control over additives, however, it is found useful if each substrate is controlled with respect to moisture content before conversion into filter elements for testing. In addition, a filter element and its active additive components can be usefully further isolated or shielded from direct contact with the lips by applying the active component onto a tow, sliver or nonwoven fabric which is, in turn, sandwiched within two or more untreated nonwoven fabrics of lesser permeability (Ref. FIG. 3). In addition, the resulting filter element can be externally coated with cork or similar inert heat-insulating material (not shown). The amount and effectiveness of modifier(s) applied to filter elements in the above way is determined substantially by the substrate width and number of substrates which are fed simultaneously into a garniture, as well as the amount of treated surface exposed to cigarette smoke in the filter element.

For present purposes, both treated and combinations of treated and untreated fabric ribbon, tow, and the like can be usefully wrapped using regular Plug wrap paper having a weight within a range of about 25–90 g/m$^2$ or higher, as desired.

Figure 2:
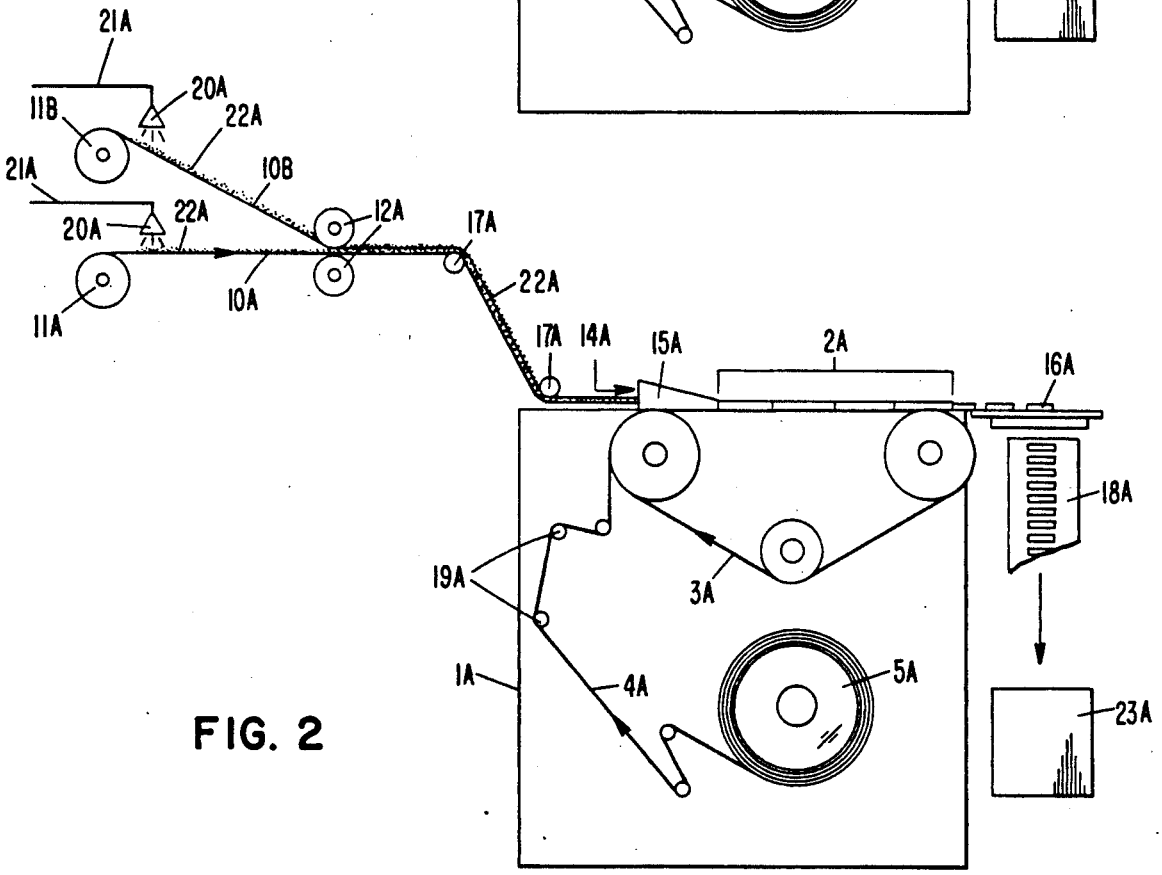
Figure 4:
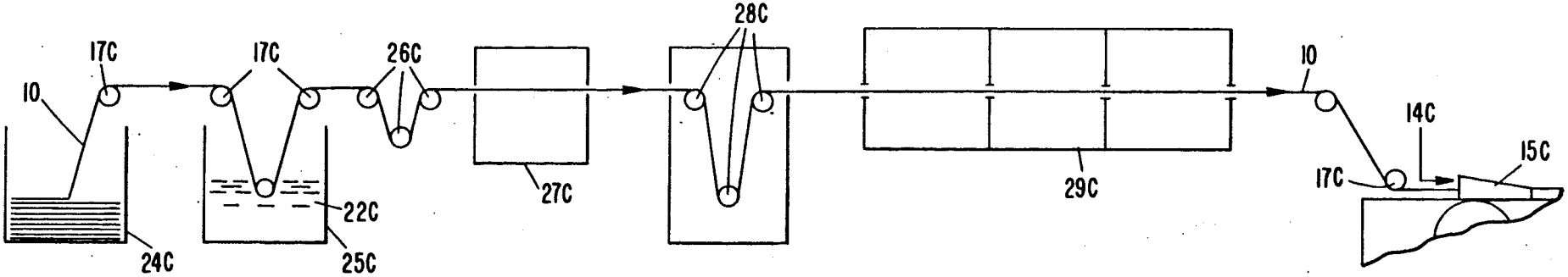

The instant invention is further illustrated in FIGS. 1–4, wherein FIG. 1 diagrammatically represents a conventional cigarette filter rod-making apparatus capable of converting substrates, as above described, and in accordance with the instant invention, into filter elements; FIGS. 2–4 diagrammatically represent further modifications and improvements within the instant invention, whereby one or more tows, slivers, ribbons of nonwovens, and fibrillated film are treated with one or more active modifier components as above described by spraying or dipping, the use of multiple substrates in this manner favoring increased filter element bulk and improved crush resistance, or hardness.

Referring to FIG. 1 in further detail, a single continuous substrate such as opened fiber tow, sliver, fibrillated film or ribbon of nonwoven fabric (10) is fed from feed reel (11) or a bale (not shown) and across one or more opposed spray heads (20) feedably connected to feed lines (21) from outside sources (not shown) to apply one or more active modifier component (22). The resulting treated substrate is then dried by air drying means (not shown) and by passing through drying rolls (12), to obtain the desired degree of dryness, and then led by guide rolls (17) into a garniture trumpet (15) and garniture (14) of a cigarette filter rod manufacturing apparatus (1), comprised of a garniture section (2) including (but not showing) means for shaping and retaining the substrate feed, wrapping means, and cutting means for converting the wrapped plug or rod into filter element (16); the wrapping means is conveniently supplied with tow wrap from wrap feed reel (5) supported by support rolls (19) and moved onto a continuous garniture belt (3) for introduction into the rod-making apparatus.

The apparatus, as described, comprises conventional means for sealing a tow wrap around a filter plug (not shown), the wrapped plug then being cut by cutting means into generally cylindrical filter elements (16) of desired length (normally 90 mm or more), which are removed through filter chute (18) (shown in fragment) for packing in container (23).

FIG. 2 diagrammatically demonstrates a further arrangement for separately applying active modifier component(s) onto a garniture feed or substrate (10A) whereby differently arranged spray heads (20A) fed by connecting feed lines (21A), separately apply active modifier components (22A) (identical or otherwise) onto different substrates (10A, 10B), which are dried using air and heated rolls (12A), before being fed through garniture (14A) of rod-making apparatus (1A), to form filter elements (16A) as before. Substrates (10A and 10B), are fed from feed rolls (11A) and (11B) or bales (not shown) and conveniently brought into register at heated nip rolls (12A), then guided by guide rolls (17A) into garniture (14A), the garniture feed or substrate components shown being similarly defined by arabic numbers in each of FIGS. 1–3.

FIG. 3 diagrammatically demonstrates a further modification of the equipment and process of FIGS. 1 and 2, whereby several substrates of the same or different types (10C, 10D, and 10E), as described above, from reels or boxes (not shown) are fed through a nip created by heated rolls (12B), the middle substrate (10D) preferably being of different width and having higher absorption or adsorption properties for retaining active components (22B) than the two external untreated substrates (10C and 10E). As shown, substrate (10D) is sprayed on both sides to selectively expose it to one or more active modifier components (22B) applied by spray heads (20B) fed from feedlines (21B), one substrate (10E) preferably being arranged so as to catch surplus drip or misdirected active components not retained or captured by ribbon (10D), all three substrates are then air dried by passing in register through heated nip rolls (12B), as before, and directed by guide rolls (not shown) into the garniture of a filter rod apparatus in the manner of FIGS. 1 and 2. FIG. 4 is a diagrammatic representation of a further modification in which one or more substrates, as above defined, (shown as 10C) are separately fed from a bale or box (24C), passed over guide rolls (17C), and dipped into a reservoir (25C) containing one or more active modifier component(s) (22C) in solution, suspension, or emulsion, and then passed through nip rolls (26C), through a heating oven (27C), drawer rolls (28C), a three step drying oven (29C), then to garniture (14C) of a cigarette rod manufacturing apparatus in the manner of FIGS. 1–3, supra, or boxed and stored for future use.

Where a continuous fiber tow is used as a substrate component, preparation of the tow is conveniently carried out in the usual way by drawing the fiber from one or more creels through a fluid bulking or texturing jet (not shown in figures) and then handled as noted above.

Substrates which are employed in the above manner can usefully comprise a variety of synthetic filaments as noted above. Thus, it is possible to use polyesters, polyamides, acrylics, as well as polypropylene and the like. Due to its relatively low density, compared to other synthetic fiberforming material and excellent spin properties, combinations of filament-forming copolymers of propylene with ethylene or other lower olefin monomers are particularly preferred as tow, nonwoven ribbon and fibrillated film material.

The bulk denier of a tow for carrying out the present invention can conveniently fall between about 2,000 and 10,000, and this substrate can be supplied as a crimped fiber from a single creel or bale, or a composite of several creels or bales combined and passed through a fluid jet simultaneously. For best performance of fiber tow as cigarette filters, however, it is preferred that at least some tow be substantially untwisted and untexturized prior to entering a fluid jet.

The invention is further illustrated by the following Examples.

EXAMPLE 1

(A) Baled 4.5 dpf "y" cross section polypropylene fiber obtained from melt spun isotactic polypropylene having a flow rate of 35.2 gm/10 minutes, is broken, opened, carded, crimped and pulled to form a thin tow ribbon about 12–14 inches in width. The ribbon is drawn, without further treatment, through the garniture of a conventional filter rod-forming apparatus, here identified as model PM-2 obtained from Molins Ltd. of Great Britain, and compressed to form filter plugs which are wrapped with BXT-100 polypropylene film to form 108 mm filter rods. The rods are then cut into 27 mm lengths of substantially equal weight, and draw*1 and taped onto R. J. Reynolds' Camel Light tobacco plugs, stored for 48 hours in a humidity cabinet at 55%-65% relative humidity at 22° C.*2, and

*1 All tested filter elements have a resistance to draw (RTD) within the range of 111-136 mm Wg (water gauge).
*2 According to CORTESTA Standard Method #10 then used as control samples group-wise identified as C-1 through C-15; the samples are identically smoked down to 35 mm lengths in two second puffs per minute on a Borgwaldt smoking machine*3. The particulate matter in the resulting smoke is trapped in a preweighed Cambridge filter pad, and the pad reweighed to determine total and average particulate matter (TPM) passed through the cigarette filter. The Cambridge pad is then soaked overnight in anhydrous isopropyl alcohol, and the resulting extract conventionally tested for nicotine and water content using a GC (gas chromatograph) autosampler*4.

*3 Models RM 20/CS 20 and RM 1/G
*4 Hewlett Packard Model HP5890

Formaldehyde determinations are run on a 10 cigarette sample basis (5 controls and 5 treated samples) by directing a measured volume of cigarette smoke into a collection bottle containing a saturated 2.2N HCl solution of 2,4-dinitrophenylhydrazine (DNPH) and 25 ml methylene chloride, the bottle is shaken for 2 hours, and the phases allowed to separate. Aliquot samples of the methylene chloride phase are then removed by syringe for conventional (HPLC) formaldehyde analysis.

(B) Fiber tow from the same bale is identically processed to obtain ten test filter elements in the manner of Example 1A except that the 27 mm cut filter elements are then treated with a 2% solution of calcium bromide, using a suction bulb to draw up and impregnate each filter element with an amount of solution sufficient to uniformly impregnate with about 15 mg. of the calcium salt. The test filter elements are then oven dried, stored in a humidity cabinet for 48 hours, and then taped to an R. J. Reynolds' Camel Light tobacco plug as before. Conventional tests for total particulate matter (TPM), filter efficiency, nicotine and formaldehyde are run as before, averaged on a per cigarette basis, and reported in Table I below as S-1.

(C) Fiber tow from the same bale as Example 1A (supra) is identically processed, except that the cut filter elements (identified as S-2 through S-4, S-6, S-8 through S-11 and S-13) are impregnated with various solutions of one of zinc thiocyanate, sarcosine hydrochloride, ferrous bromide, zinc chloride, or lithium bromide to obtain an effective concentration of the active salt equal to about 10-20 mg/filter element. The resulting treated and dried 27 mm filter elements are conventionally taped to R. J. Reynolds' Light tobacco plugs as before, stored in a humidity cabinet for 48 hours, and smoked as before. Samples are collected and identical tests are then run, the average results being reported in Table I.

(D) Fiber tow from the same bale as Example 1A is identically processed to form filter elements except that the active components (zinc thiocyanate and sarcosine hydrochloride respectively) are sprayed onto the open fiber tow in the form of 20% by weight aqueous solutions in an amount equal to 1% by weight and air dried before feeding into a garniture to form a filter rod. The resulting test elements, identified as S-5 and S-7 are otherwise treated in the same manner as before and test results reported in Table I.

(E). Filter tow from the same bale as Example 1A is identically processed as in Example 1B except that the 27 mm cut filter element (identified as S-12) is uniformly impregnated with a mixture of triacetin (1%) and calcium bromide (2%) by weight dissolved in a 4:1 (by volume) ratio of water:alcohol as active modifier components. The sample is dried, stored in a humidity cabinet and tested as before (see Table 1).

Control (C-10) is prewetted with the 4:1 water:alcohol solution without active components, dried, stored and smoked in an identical manner as before and test results reported in Table 1.

TABLE 1

| SAMPLE | TREATMENT*8 ACTIVE COMPONENT | TPM RETAINED (mg)*6 | TPM DELIVERED (mg)*6 | FILTER EFFICIENCY (%) | NICOTINE (mg)*6 | FORMALDEHYDE (ug)*6 |
|---|---|---|---|---|---|---|
| S-1 | Calcium Bromide (2%) | 25.2 | 13.5 | 64.9 | 0.55 | 12.4 |
| C-1 | Control | 27.8 | 19.7 | 58.5 | 0.88 | 29.1 |
| S-2 | Zinc Thiocyanate (2%) | 32.8 | 13.2 | 71.3 | 0.45 | 25.5 |
| C-2 | Control | 26.8 | 17.8 | 60.1 | 0.57 | 31.0 |
| S-3 | Zinc Thiocyanate (1.35%) | 27.4 | 13.6 | 66.7 | — | —*9 |
| C-3 | Control | 29.1 | 17.7 | 62.0 | — | —*9 |
| S-4 | Zinc Thiocyanate (4%) | 37.2 | 14.9 | 71.4 | — | —*9 |
| C-4 | Control | 29.2 | 14.8 | 66.5 | — | —*9 |
| S-5 | Zinc Thiocyanate*5 | 20.8 | 16.5 | 55.8 | 0.88 | —*9 |
| C-5 | PP Treated With Water | 16.6 | 18.6 | 47.1 | 1.01 | —*9 |
| S-6 | Sarcosine Hydrochloride (2%) | 33.1 | 15.6 | 68.0 | 0.75 | 7.3 |
| C-6 | Control | 28.8 | 19.5 | 59.7 | 0.90 | 9.5 |
| S-7 | Sarcosine Hydrochloride*7 | 20.3 | 16.8 | 54.7 | 0.88 | —*9 |
| C-7 | PP Sprayed With Water | 16.0 | 15.8 | 50.2 | 1.00 | —*9 |
| S-8 | Ferrous Bromide (2%) (In Isopropanol) | 28.9 | 14.9 | 65.4 | — | —*9 |
| S-9 | Zinc Chloride (2%) (In Methanol) | 29.4 | 17.2 | 63.0 | — | —*9 |
| C-8 | Control (for S-8 and S-9) | 25.5 | 19.1 | 58.1 | — | —*9 |
| S-10 | Ferrous Bromide (4%) (In Isopropanol) | 31.0 | 16.1 | 64.9 | 0.52 | —*9 |
| S-11 | Zinc Chloride (4%) (In Methanol) | 30.2 | 16.4 | 64.5 | 0.72 | —*9 |
| C-9 | Control | 26.0 | 18.4 | 58.5 | 0.60 | —*9 |
| S-12 | Calcium Bromide (2%) Glyceryl Triacetate (1%) | 28.2 | 16.1 | 63.7 | — | —*9 |
| C-10 | Control | 24.6 | 19.0 | 56.4 | — | —*9 |
| S-13 | Lithium Bromide (2%) | 30.8 | 16.0 | 65.4 | 0.62 | 17.0 |

TABLE 1-continued

| SAMPLE | TREATMENT*8 ACTIVE COMPONENT | TPM RETAINED (mg)*6 | TPM DELIVERED (mg)*6 | FILTER EFFICIENCY (%) | NICOTINE (mg)*6 | FORMALDEHYDE (ug)*6 |
|---|---|---|---|---|---|---|
| C-11 | Control | 28.0 | 19.2 | 58.0 | 0.92 | 49.0 |

*5 20% by weight solution sprayed on; equivalent to 1% by weight
*6 Average/10 Cigarettes
*7 20% by weight solution sprayed on; equivalent to 1.5% by weight
*8 In % by weight solution
*9 Determinations not completed

EXAMPLE 2

Filter rods, filter elements and test cigarette samples are prepared as described in Example 1, except that 2% and 5% by weight aqueous solutions of (a) manganese sulfate or (b) manganese sulfate plus glyceryl triacetate are drawn up into each filter element*15 in an amount equal to about 20 and 45 mg/element respectively, oven dried, stored in a humidity cabinet for 48 hours, taped onto Camel light tobacco plugs, and identically smoked, tested as in Example 1, based on average test results and reported in Table 2 as S-14, S-15, S-16 and S-17 with corresponding controls C-12, C-13, C-14 and C-15 respectively.

*15 to saturation with slight flow through observed

TABLE 2

| Sample | Active Component | Tar (mg) (*6) | Nicotine (mg) Cigarette (*10) | Filter Efficiency (*10) | HCHO (ug) |
|---|---|---|---|---|---|
| S-14*10 | Manganese Sulfate (2%) | 14.1 | .84 | 65.3% | 15.8 |
| C-12*10 | Control | 15.8 | .96 | 59.5% | 28.2 |
| S-15*11 | Manganese Sulfate (5%) | 12.7 | .72 | 67.8% | 20.8 |
| C-13*11 | Control | 16.0 | .97 | 57.5% | 44.1 |
| S-16*12 | Manganese (2%) Sulfate & Glyceryl Triacetate (2%) | 11.0 | 1.08 | 64.4% | —*13 |
| C-14*12 | Control | 14.9 | 1.0 | 59.3% | —*13 |
| S-17*12 | Manganese Sulfate (5%)*14 | 16.0 | 1.04 | 56.0 | —*13 |
| C-15*12 | Control | 14.3 | .95 | 58.9 | —*13 |

*10 Sample size = 8 cigarettes
*11 Sample size 40 cigarettes
*12 Sample size 10 cigarettes
*13 Determination not run
*14 and glyceryl triacetate (5%)

TABLE 3

| SAMPLE | ACTIVE COMPONENT | CONCENTRATION | TAR/CIGARETTE (mg/cigarette) | NICOTINE (mg/cigarette) | FILTER EFF. % |
|---|---|---|---|---|---|
| S-18*17 | $MgCl_2$ | 2% | 11.12 | .384 | 69.90 |
| S-19 | $MgCl_2$ | 5% | 11.98 | .660 | 71.20 |
| S-20 | Mg $SO_4$ | 2% | 11.01 | .901 | 65.40 |
| S-21 | Mg $SO_4$ | 5% | 13.47 | 1.049 | 66.20 |
| S-22 | $Mg(O—Ac)_2$*16 | 2% | 10.23 | 1.081 | 65.70 |
| S-23 | $Mg(O—Ac)_2$ | 5% | 14.24 | 1.146 | 56.00 |
| S-24 | $Mn(O—Ac)_2$ | 2% | 10.49 | 1.127 | 66.80 |
| S-25 | $Mn(O—Ac)_2$ | 5% | 13.80 | 1.097 | 62.50 |
| C-16*18 | — | — | 14.88 | .922 | 58.6 |

*16 O—Ac = an acetoxy group.
*17 based on a 10 cigarette sample.
*18 based on a 400 cigarette sample.

EXAMPLE 3

Filter rods, filter elements and test cigarette samples are prepared as described in Example 2, except that 2% and 5% by weight aqueous solutions of magnesium chloride (S-18, S-19) magnesium sulfate (S-20, S-21) magnesium acetate (S-22, S-23) and manganese acetate (S-24, S-25) are drawn through each filter element with a bulb,*15 to incorporate about 20 and 45 mg of the salt as before, oven dried, stored, taped onto Camel light tobacco plugs of the same length and diameter, smoked and tested as before. The test results are reported in Table 3 as S-18 through S-25. Corresponding untreated filter elements and tobacco plugs are averaged and used as control C-16.

*15 to saturation with slight flow through observed

What I claim and desire to protect by Letters Patent is:

1. A method for controlling the delivery of by-products found in cigarette smoke, comprising passing cigarette smoke through a filter element of compacted substrate containing an effective amount of at least one active modifier component selected from the group consisting of zinc thiocyanate, sarcosine hydrochloride, zinc chloride, ferrous bromide, lithium bromide, manganese sulfate, manganese acetate, magnesium chloride, magnesium sulfate and magnesium acetate.

2. A method of claim 1, wherein the filter element is obtained from polyolefin-containing substrate in the form of at least one of a (a) opened fiber tow, (b) ribbon of nonwoven material, (c) sliver and (d) fibrillated film.

3. A method for controlling the delivery of tar, nicotine, formaldehyde and total particulate matter found in cigarette smoke, comprising passing the cigarette smoke through a polyolefin-containing filter element containing an effective amount of active modifier components comprising (A) at least one member selected from the group consisting of zinc thiocyanate, sarcosine hydrochloride, ferrous bromide, calcium bromide, lithium bromide, manganese sulfate, manganese acetate, magnesium chloride, magnesium sulfate and magnesium acetate; and (B) glyceryl triacetate.

4. A method of claim 2, wherein the active modifier component comprises zinc thiocyanate.

5. A method of claim 2, wherein the active modifier component comprises sarcosine hydrochloride.

6. A method of claim 2, wherein the active modifier component comprises zinc chloride.

7. A method of claim 2, wherein the active modifier component comprises ferrous bromide.

8. A method of claim 3, wherein the active modifier component comprises calcium bromide.

9. A method of claim 2, wherein the active modifier component comprises lithium bromide.

10. A method of claim 2, wherein the active modifier component comprises manganese sulfate.

11. A method of claim 2 wherein the active modifier component comprises manganese acetate.

12. A method of claim 2, wherein the active modifier component comprises magnesium chloride.

13. A method of claim 2, wherein the active modifier component comprises magnesium sulfate.

14. A method of claim 2, wherein the active modifier component comprises magnesium acetate.

15. A method of claim 2, wherein active modifier components are applied to separate substrate surfaces and the substrate introduced as garniture feed into a filter rod-making apparatus.

16. The method of claim 2, wherein the filter element contains a polyoxyalkylene derivative of a sorbitan fatty acid ester.

17. The method of claim 2, wherein the filter element contains a fatty acid monoester of a polyhydroxy alcohol.

18. The method of claim 2, wherein the filter element contains a fatty acid diester of a polyhydroxy alcohol.

19. The method of claim 2, wherein the polyolefin-containing substrate is pretreated by corona or plasma discharge before application of active modifier component thereto.

20. A tobacco smoke filter element comprising a filter plug of compacted substrate from at least one of (a) opened fiber tow (b) ribbon of nonwoven material, (c) sliver, or (d) fibrillated film, and comprising an effective amount of at least one active modifier of at least one of zinc thiocyanate, sarcosine hydrochloride, zinc chloride, ferrous bromide, lithium bromide, manganese sulfate, manganese acetate, magnesium chloride, magnesium sulfate, and magnesium acetate.

21. The filter element of claim 20, wherein the active modifier component comprises zinc thiocyanate.

22. The filter element of claim 20, wherein the active modifier component comprises sarcosine hydrochloride.

23. The filter element of claim 20, wherein the active modifier component comprises zinc chloride.

24. The filter element of claim 20, wherein the active modifier component comprises ferrous bromide.

25. The filter element of claim 20, wherein the active modifier component comprises lithium bromide.

26. The filter element of claim 20, wherein the active modifier component comprises manganese sulfate.

27. The filter element of claim 20, wherein the active modifier component comprises manganese acetate.

28. The filter element of claim 20, wherein the active modifier component comprises magnesium chloride.

29. The filter element of claim 20, wherein the active modifier component comprises magnesium sulfate.

30. The filter element of claim 20, wherein the active modifier component comprises magnesium acetate.

31. A cigarette comprising a tobacco rod in serial combination with a filter element as defined in claim 20.

32. A filter element from a filter plug comprising polyolefin substrate and an active modifier component of (A) about 0.05%–10% by weight of a member selected from the group consisting of zinc thiocyanate, sarcosine hydrochloride, zinc chloride, ferrous bromide, lithium bromide, manganese sulfate manganese acetate, magnesium chloride, and magnesium acetate; and (B) up to about 5% by weight of glyceryl triacetate.

33. A cigarette comprising a tobacco rod in serial combination with a filter element as defined in claim 32.

* * * * *